US006843645B2

(12) United States Patent
Terada et al.

(10) Patent No.: US 6,843,645 B2
(45) Date of Patent: Jan. 18, 2005

(54) COOLING SYSTEM FOR A MAGNETIC PUMP

(75) Inventors: Keiichi Terada, Iruma-gun (JP); Toshihiko Kondo, Iruma-gun (JP); Yasumasa Kurihara, Iruma-gun (JP); Koichi Kato, Iruma-gun (JP); Takahiro Kinoshita, Iruma-gun (JP)

(73) Assignee: Iwaki Co., Ltd., Tokyo (JP)

( * ) Notice: Subject to any disclaimer, the term of this patent is extended or adjusted under 35 U.S.C. 154(b) by 27 days.

(21) Appl. No.: 10/333,024

(22) PCT Filed: Jun. 5, 2001

(86) PCT No.: PCT/JP01/04744

§ 371 (c)(1),
(2), (4) Date: Jan. 15, 2003

(87) PCT Pub. No.: WO02/099283

PCT Pub. Date: Dec. 12, 2002

(65) Prior Publication Data

US 2004/0009079 A1 Jan. 15, 2004

(51) Int. Cl.[7] ..... F04B 39/10; F04B 1/04; F04B 19/00

(52) U.S. Cl. ..... 417/554; 417/273; 417/470; 417/555.1; 417/562; 417/567; 417/569

(58) Field of Search ..... 417/273, 470, 417/421, 545, 554, 555.1, 562, 563, 567, 569, 570, 571, 420, 366, 373, 423.14, 211.2, 224.5, 115, 116; 415/211.2, 224.5, 115, 116

(56) References Cited

U.S. PATENT DOCUMENTS

| | | | | | |
|---|---|---|---|---|---|
| 3,221,661 | A | * | 12/1965 | Swearingen | 417/370 |
| 4,013,384 | A | * | 3/1977 | Oikawa | 417/368 |
| 4,207,485 | A | * | 6/1980 | Silver | 310/104 |
| 4,793,777 | A | * | 12/1988 | Hauenstein | 417/365 |
| 5,064,344 | A | * | 11/1991 | Kassel et al. | 415/224.5 |
| 5,228,832 | A | * | 7/1993 | Nishida et al. | 415/208.1 |
| 5,322,421 | A | * | 6/1994 | Hansen | 417/420 |
| 5,464,333 | A | * | 11/1995 | Okada et al. | 417/420 |
| 6,074,180 | A | * | 6/2000 | Khanwilkar et al. | 417/356 |

FOREIGN PATENT DOCUMENTS

| | | |
|---|---|---|
| EP | 0 778 658 A1 | 6/1997 |
| JP | U 61-101690 | 6/1986 |
| JP | A 8-135592 | 5/1996 |
| JP | A 8-166000 | 6/1996 |
| JP | A 11-210669 | 8/1999 |

* cited by examiner

*Primary Examiner*—Cheryl J. Tyler
*Assistant Examiner*—Timothy P. Solak
(74) *Attorney, Agent, or Firm*—Oliff & Berridge, PLC

(57) ABSTRACT

A magnet pump includes a synthetic resin casing, divided into a front casing and a rear casing and configured to internally form an impeller housing chamber and a magnet can housing chamber contiguous thereto, having an inlet and an outlet for a target fluid to be transferred. The casing forms an eddy chamber at a position for dividing the front casing and the rear casing along the outer rim of the impeller housing chamber to surround the outer rim of the impeller. The eddy chamber has overhangs formed at an entry of the eddy chamber hanging over from both sides in the rotational-axis direction of the impeller.

4 Claims, 4 Drawing Sheets

COOLING SYSTEM FOR A MAGNETIC PUMP

TECHNICAL FIELD

The present invention relates to a magnet pump, which includes a rotator consisting of an impeller and a magnet can, and a support means for rotatably supporting the rotator to rotationally drive the magnet can from outside a rear casing. In particular, it relates to a magnet pump, which includes front and rear casings composed of synthetic resin.

BACKGROUND ART

A magnet pump including front and rear casings composed of synthetic resin has been employed for the use of transferring a corrosive liquid, for example. In such the magnet pump, the front casing forms a pumping chamber and the rear casing forms a cylindrical space contiguous to the pumping chamber. The cylindrical space in the rear casing is employed to locate a cylindrical magnet can that is rotatably supported by a support shaft, one end of which is secured on the rear casing. Outside the magnet can, a rotary driver is located and magnetically coupled to the magnet can through the rear casing. The driving force from the rotary driver is employed to rotate the magnet can. The magnet can is integrally coupled to an impeller, which is housed in the pumping chamber. When the impeller rotates, a target fluid to be transferred is introduced into the inside of the pumping chamber through an inlet formed at the front of the front casing and discharged through an outlet formed at the side of the front casing.

The rotator consisting of the magnet can and the impeller has a sliding portion, which is located at the inner diameter side in the vicinity of the impeller inlet. Therefore, if bubbles are mixed into the target fluid, the bubbles concentrate inwardly due to a difference in their specific gravity and invite an incomplete cooling action by the target fluid at the sliding portion, resulting in the sliding portion heated easily. A spindle boss arranged in the vicinity of the sliding portion has just a small clearance with peripheral members and hardly radiates heat. Thus, the conventional magnet pump with the synthetic resin casing causes a problem because the synthetic resin casing may be deformed or melted due to the heat caused by mixed bubbles and poor heat radiation.

DISCLOSURE OF INVENTION

The present invention has been made in consideration of such the problem and accordingly has an object to provide a magnet pump intended to avoid heating caused by mixed bubbles and poor heat radiation to improve the reliability.

A magnet pump according to the present invention comprises a synthetic resin casing divided into a front casing and a rear casing and configured to internally form a first housing chamber, a second housing chamber contiguous thereto, and an eddy chamber along the outer rim of the first housing chamber, having an inlet formed at the first housing chamber and an outlet formed at the eddy chamber for a target fluid to be transferred; a substantially cylindrical magnet can with a follower magnet mounted on the outer rim thereof, housed in the second housing chamber of the casing; a support means for rotatably supporting the magnet can relative to the casing; a disk-like impeller fixed at the front end of the magnet can so as to rotate integrally with the magnet can, having a flow path formed inside to suck the target fluid from the center (for example, the front of the front casing), transfer the target fluid outward in the radial direction, and discharge the target fluid from the outer rim, and housed in the first housing chamber; and a rotational driving means magnetically coupled to the follower magnet through the casing for applying a rotational driving force to the impeller through the follower magnet, wherein the eddy chamber in the casing is formed at a position for dividing the front casing and the rear casing to surround the outer rim of the impeller, the eddy chamber having overhangs formed at an entry thereof hanging over from both sides in the rotational-axis direction of the impeller.

According to the present invention, the eddy chamber is formed at a position for dividing the casing into its constituents, or the front casing and the rear casing, along the outer rim of the first housing space to surround the outer rim of the impeller. In addition, the eddy chamber has overhangs formed at an entry thereof hanging over from both sides in the rotational-axis direction of the impeller. Therefore, if bubbles are mixed into the target fluid sucked from the center and discharged from the outer rim of the impeller, the bubbles discharged from the outer rim of the impeller can be prevented from returning to the first housing chamber along the outer surface of the impeller by the overhangs at the entry of the eddy chamber. Therefore, the bubbles are effectively discharged from the outlet via the eddy chamber and bubbles staying in the vicinity of the sliding portion of the rotator can be reduced. This is effective to reduce heating caused by mixed bubbles at the sliding portion of the rotator, and prevent the synthetic resin casing from deforming and melting.

Desirably, the clearance between the outer rim of the impeller and the overhang in the eddy chamber is set slightly larger than the backlash movement of the impeller in the radial direction. Desirably, in consideration of the amount of the bearing abrasion in the axial direction of the impeller, the gap between the opposite tips of the overhangs is set larger than a distance that the outer rim of the impeller moves as the impeller moves in the axial direction. This allows the outlet on the outer rim of the impeller to be always contained within the gap sandwiched between the overhangs. If the gap between the overhangs is smaller than the distance, the overhangs interfere with the fluid discharged from the impeller. This is not preferable on pump performance.

Another magnet pump according to the present invention comprises a synthetic resin casing divided into a front casing and a rear casing and configured to internally form a first housing chamber and a second housing chamber contiguous thereto, having an inlet and an outlet formed at the first housing chamber for a target fluid to be transferred; a substantially cylindrical magnet can with a follower magnet mounted on the outer rim thereof, housed in the second housing chamber of the casing; a support means for rotatably supporting the magnet can relative to the casing; a disk-like impeller fixed at the front end of the magnet can so as to rotate integrally with the magnet can, having a flow path formed inside to suck the target fluid from the center (for example, the front of the front casing), transfer the target fluid outward in the radial direction, and discharge the target fluid from the outer rim, and housed in the first housing chamber; and a rotational driving means magnetically coupled to the follower magnet through the casing for applying a rotational driving force to the impeller through the follower magnet, wherein a cooling hole is formed at a coupling portion between the magnet can and the impeller to flow the target fluid outward from the axial center thereof in the radial direction.

According to the present invention, the cooling hole is formed at the coupling portion between the magnet can and the impeller to flow the target fluid from the axial center thereof to the outside in the radial direction. Therefore, even if bubbles are mixed into the target fluid and the sliding portion of the support means is heated, the fluid and bubbles in the vicinity of the sliding portion can be discharged outside and agitated through the cooling hole. This is effective to reduce the heat caused from the sliding portion and prevent temperature elevations in the vicinity of the sliding portion.

At the position for dividing the casing into the front casing and the rear casing, an eddy chamber may be formed along the outer rim of the first housing space so as to surround the outer rim of the impeller. In addition, overhangs hanging over from both sides at the entry of the eddy chamber may be formed in the rotational-axis direction of the impeller. This can be further effective due to the above action to prevent the heating and poor heat radiation.

In addition, the magnet can and the impeller may be coupled by a pin passing through both in the radial direction. In this case, the fastening force at the fastened portion can not be reduced by vibrations, time variation or heat, or the inertial force when the pump reverses the direction of rotation or halts. Accordingly, it is possible to avoid various malfunctions such as sliding-heat to be caused when the magnet can and the impeller come loose, and to improve the reliability. In this case, the magnet can and the impeller can be easily disassembled and assembled and replaced on a part basis.

Preferably, the coupling plane between the magnet can and the impeller has rotational driving force transmission surfaces extending in the radial direction. According to such the arrangement, the magnet can and the impeller can be fixed in the rotational direction (driving force transmission direction) mainly by the rotational driving force transmission surfaces without exerting a large load on the pin. This is effective to design the pin thinner and smaller accordingly.

The support means for rotatably supporting the magnet can relative to the casing may be configured to include: a spindle, located in the second housing space, having a rear end supported by the rear end of the rear casing, and a front end supported by a shaft support that extends toward the center of the first housing space; and a cylindrical rotary bearing rotatably supported by the spindle and mounted on the inner rim in the magnet can. Alternatively, the support means may be configured to include: a spindle, located in the second housing space, having a rear end rotatably supported by the rear end of the rear casing, and a front end rotatably supported by a shaft support that extends toward the center of the first housing space, and mounted on the inner rim in the magnet can; a rear bearing for rotatably supporting the rear end of the spindle at the rear end of the rear casing; and a front bearing for rotatably supporting the front end of the spindle at the shaft support.

BEST MODE FOR CARRYING OUT THE INVENTION

Preferred embodiments of the present invention will be described below with reference to the drawings.

Figure 1:
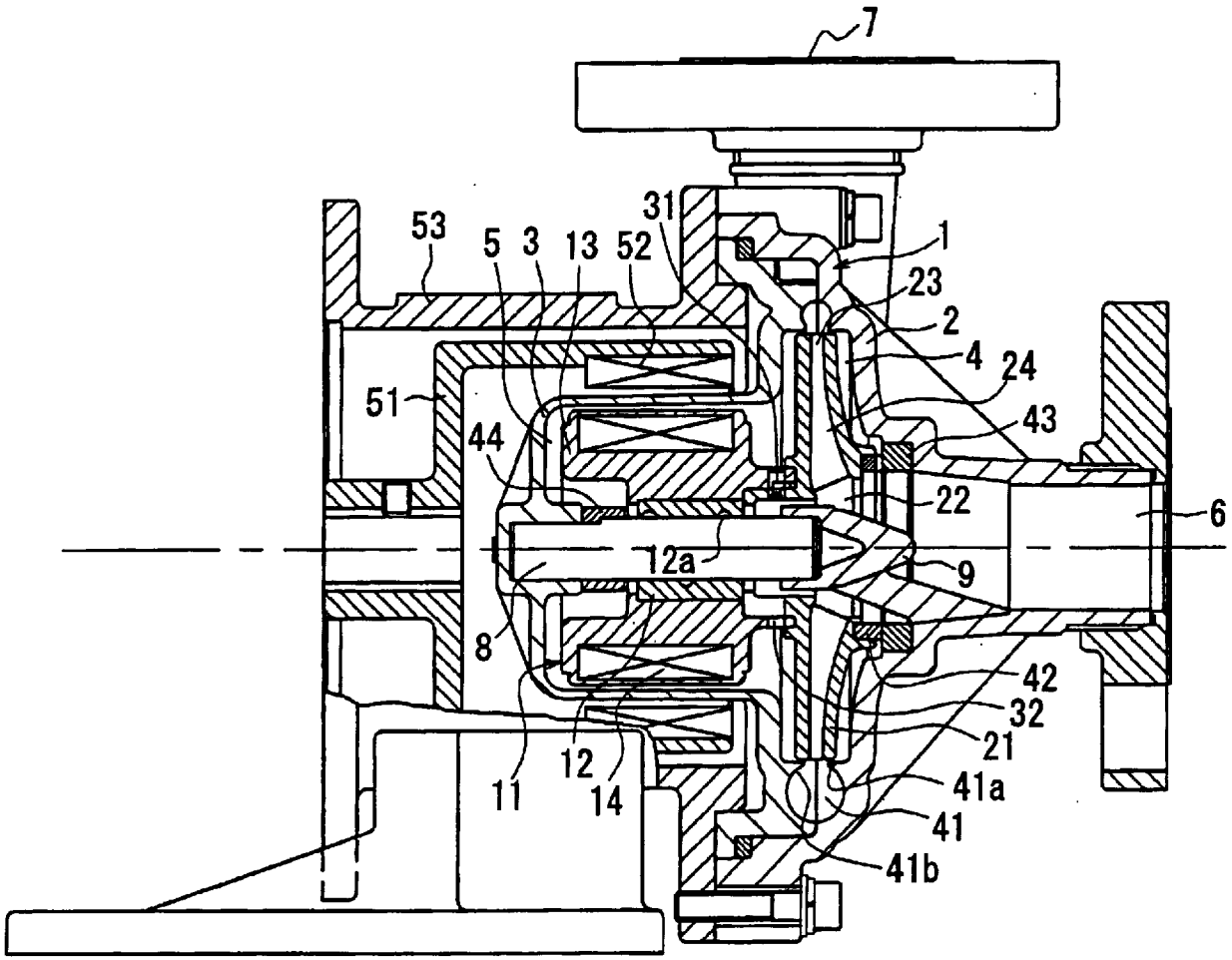
FIG. 1 is a cross-sectional view showing the major part of a magnet pump according to an embodiment of the present embodiment.

FIG. 1 is a cross-sectional view showing the major part of a magnet pump according to an embodiment of the present embodiment.

A synthetic resin casing 1 is divided into a front casing 2 and a rear casing 3 and internally forms an impeller housing chamber 4 or a first housing space and a magnet can housing chamber 5 or a second housing space contiguous thereto. For a target fluid to be transferred, the front casing 2 has an inlet 6 formed at the front and an outlet 7 formed at the upper part on the side. The inlet 6 and the outlet 7 communicate with the impeller housing chamber 4, respectively. In the magnet can housing chamber 5 a spindle 8 is located facing its front end toward the impeller housing chamber 4. The rear end of the spindle 8 is fixed on the rear end of the rear casing 3 and the front end of the spindle 8 is supported by a shaft support 9. This shaft support extends toward the center of the impeller housing chamber 4 from the inner surface at the inlet 6 of the front casing 2 in three directions, for example.

A cylindrical magnet can 11 is housed in the magnet can housing chamber 5. The magnet can 11 is rotatably supported over the spindle 8 through a cylindrical rotary bearing 12 having a helical groove 12*a* formed in the inner surface. The magnet can 11 includes a cylinder 13 and a ring-shaped follower magnet 14 mounted over the outer surface of the cylinder 13. A disk-like impeller 21 is secured on the front end of the magnet can 11. The impeller 21 is internally provided with a flow path 24 that has an inlet 22 at the center of the front and an outlet 23 at the outer rim. The impeller 21 is housed in the impeller housing chamber 4 and, when it rotates, the target fluid is introduced through the inlets 6, 22 into the inside of the flow path 24 and discharged through the outlets 23, 7. Provided at a fitting portion between the magnet can 11 and the impeller 21 is a pin 31, which passes through them in the radial direction. This pin 31 restricts them from moving in the axial and rotational directions (only the axial direction if rotational driving force transmission surfaces 63, 64 are provided as described later). Also formed at the fitting portion between the magnet can 11 and the impeller 21 is a cooling hole 32, which passes through them in the radial direction.

In the inner wall of the casing 1 opposite to the outer rim of the impeller 21, an eddy chamber 41 is formed surrounding the impeller 21 from the outer circumference. This eddy chamber 41 is formed along the outer circumference of the impeller housing chamber 4 at a position that divides the front casing 2 and the rear casing 3. The eddy chamber 41 has cross sections gradually enlarged from the inlet to the outlet in the rotational direction of the impeller 21 in accordance with the pump performance. Formed at an entry of the eddy chamber 41 or an end opposite to the outlet 23 of the impeller 21 are overhangs 41*a*, 41*b*, which hang over from both sides in the axial direction.

An annular mouth ring 42 is provided at the front of the impeller 21. An annular front thrust bearing 43 is provided at a part opposite to the mouth ring 42 inside the front casing 2. The mouth ring 42 contacts the front thrust bearing 43 when the magnet can 11 slides forward during normal operation. A rear thrust bearing 44 is provided at a position on the spindle 8 opposite to the rear end of the rotary bearing 12. The rear end of the rotary bearing 12 contacts the rear thrust bearing 44 when the magnet can 11 slides backward during abnormal operation.

Located at a position on the magnet can 11 opposite to the follower magnet 14 through the rear casing 3 is a ring-shaped drive magnet 52, which is apart of a driving rotator 51 configuring a rotary driving means and is magnetically coupled to the follower magnet 14. The driving rotator 51 is driven via a driving shaft from a motor and the like, not depicted. The driving rotator 51 is isolated from the impeller housing chamber 4 and the magnet can housing chamber 5 and is housed within a space between the rear casing 3 and a driver casing 53.

According to this magnet pump, when the motor and the like, not depicted, rotationally drives the driving rotor 51 through the driving shaft to rotate the driving magnet 52, it rotates the follower magnet 52 that is magnetically coupled thereto. Subsequently, the rotary bearing 12 slides around the spindle 8 and the impeller 21 rotates to introduce the target fluid from the inlets 6, 22 into the flow path 24 in the impeller 21. The introduced target fluid is discharged outside through the outlets 23, 7.

Figure 2:
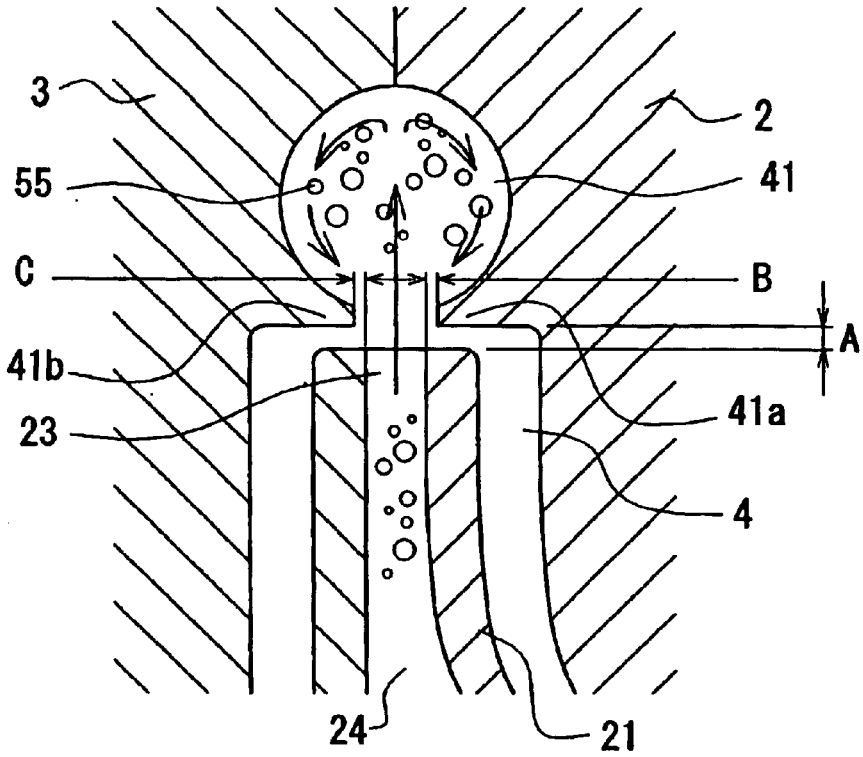
FIG. 2 is an enlarged view of the principal part for illustrating the operation of the magnet pump.

As shown in FIG. 2, bubbles 55 may be mixed into the target fluid that is sucked through the inlet at the center of the impeller 21 and discharged from the outlet 23 in the outer rim. In such the case, by means of the overhangs 41*a*, 41*b* at the entry of the eddy chamber 41, the bubbles 55 discharged from the impeller 21 and mixed into the eddy chamber 41 are prevented from returning to the impeller housing chamber 4 along the outer surface of the impeller 21. The bubbles 55 are forced to move in the circumferential direction within the eddy chamber 41 and discharged through the outlet 7. As a result, it is possible to reduce bubbles staying in the vicinity of the mouth ring 42 or the sliding portion. This is effective to avoid heating at the sliding portion to prevent the synthetic resin casing 1 to be deformed and molten.

In FIG. 2, there is a clearance A between the outer rim of the impeller 21 and the overhang 41*a*, 41*b* of the eddy chamber 41. Desirably, this clearance A is determined slightly larger than the movement of the impeller 21 due to backlash in the radial direction: for example, less than 10 mm, preferably about 2 mm. Additionally, there is a clearance B in the axial direction between the tip of the overhang 41*a* and the inner front wall of the outlet 23 of the impeller 21. Desirably, the clearance B is determined in consideration of an abrasion limit between the mouth ring 42 and the front thrust bearing 43 such that, even if the impeller 21 moves forward possibly in the axial direction, the inner front wall of the outlet 23 does not exceed forward beyond the tip of the overhang 41*a*. Similarly, there is a clearance C in the axial direction between the tip of the overhang 41*b* and the inner rear wall of the outlet 23 of the impeller 21. Desirably, the clearance C is determined in consideration of a tolerable displacement of the impeller 21 in the axial direction such that, even if the impeller 21 moves backward possibly in the axial direction, the rear inner wall of the outlet 23 does not exceed backward beyond the tip of the overhang 41*b*. If the overhang 41*a* exceeds backward beyond the inner front wall of the outlet 23, or if the overhang 41*b* exceeds forward beyond the inner rear wall of the outlet 23, the fluid discharged from the outlet 23 hits the overhangs 41*a*, 41*b* and the bubbles may be returned to the impeller housing chamber 4.

The front casing 2 and the rear casing 3 are split at the center of the eddy chamber 41, so the overhangs 41*a*, 41*b* can be formed easily using normal resin molding tools.

Figure 3:
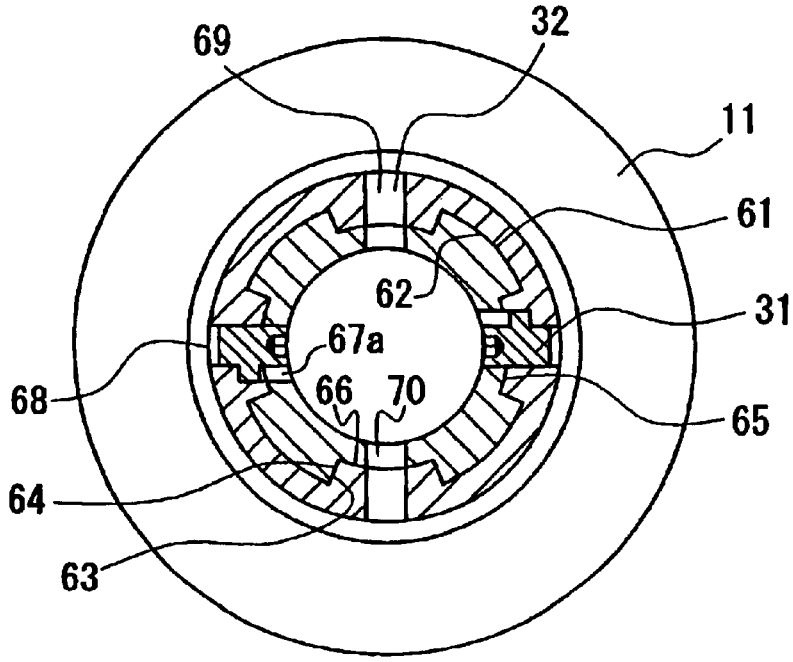
FIG. 3 is a cross-sectional view of a coupling portion between an impeller and a magnet can in the magnet pump taken in the axial direction.
Figure 4:
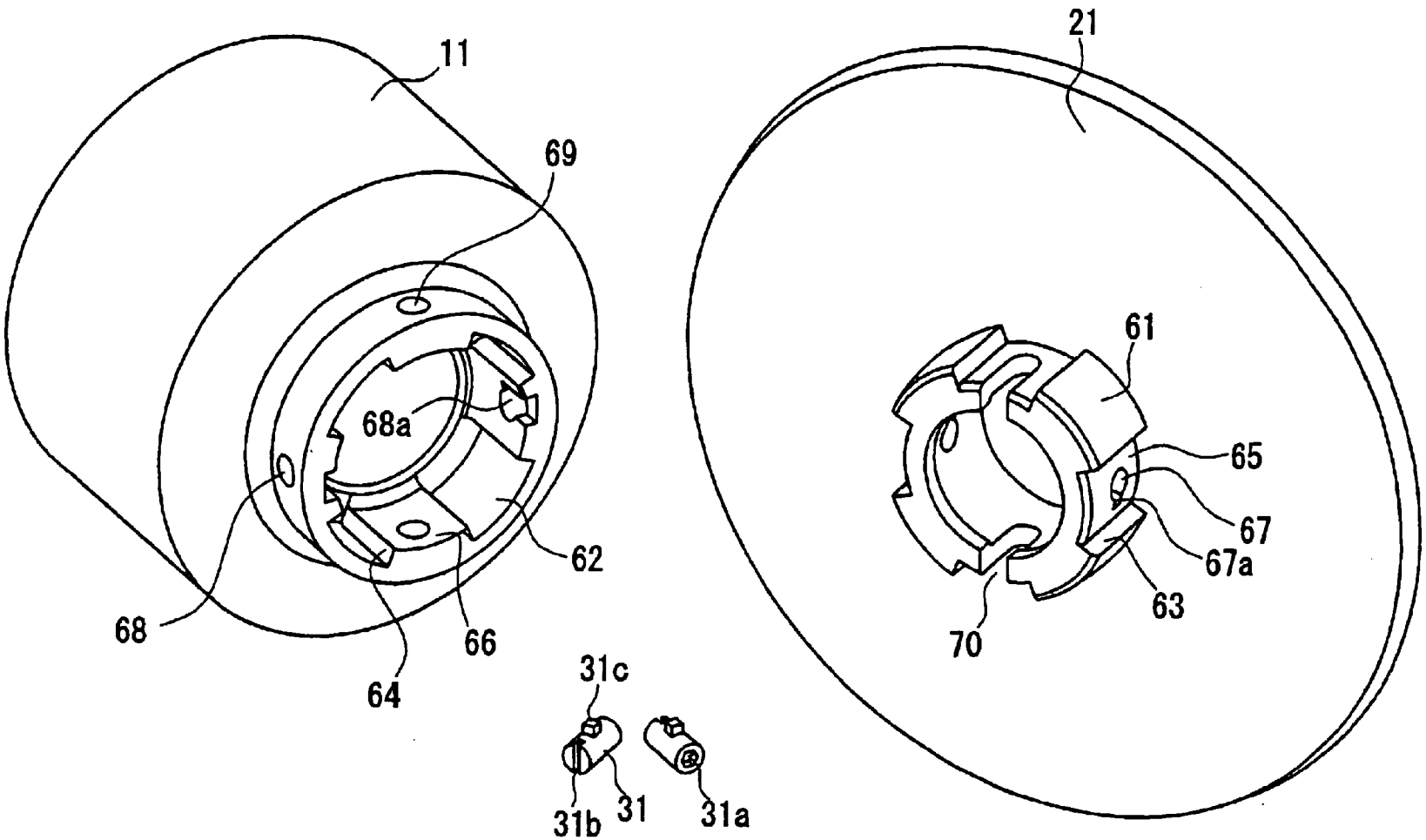
FIG. 4 is a perspective view showing the impeller and the magnet can in a state before coupling.

FIG. 3 shows a cross section illustrating the magnet can 11 seen from the axial direction of the coupling portion between the magnet can 11 and the impeller 21. FIG. 4 is a perspective view showing the impeller 11 and the magnet can 21 in a state before coupling.

As shown, at the outer rim of the rear end of the impeller 21 and the inner rim of the front end of the magnet can 11,they are fit with each other in the axial direction. Formed on the outer rim of the fitting portion of the impeller 21 are four protrusions 61, which are arrayed in the circumferential direction and protruded in the radial direction. Formed on the inner rim of the corresponding fitting portion of the magnet can 11 are recesses 62, which fit with the protrusions 61. The sides of the protrusions 61 and recesses 62, or surfaces extending in the radial direction, form rotational driving force transmission surfaces 63, 64. Formed in recesses 65 on the outer rim of the fitting portion of the impeller 21 and protrusions 66 of the magnet can 11 are holes 67, 68, 69 and notches 70, which pass through in the radial direction after both fit with each other. Among those, a pair of opposite holes 67, 68 are employed for fitting the pin 31, and the other hole 69 and the notch 70 are employed as the cooling hole 32 as shown in FIG. 3.

After the magnet can 11 is press-fitted into the impeller 21, the pin 31 is placed from the inner rim of the fitting portion of the impeller 21 to the outer rim of the fitting portion of the magnet can 11 through the holes 67, 68 in the radial direction, passing through both. For rotation, the pin 31 has a hexagonal hole 31*a* formed at the tip and a groove 31*b* formed at the bottom. It also has a protrusion 31*c* at the side. The hole 67 has a groove 67*a* formed to fit with the protrusion 31*c* of the pin 31. After the pin 31 is inserted into the hole 67, the hexagonal hole 31*a* is employed to rotate the pin 31 so that the protrusion 31*c* is engaged with a step 68*a* in the hole 68 to prevent the pin 31 from dropping off. When the pin 31 is desired to remove, a screw driver is employed to fit its tip into the groove 31*b* of the pin 31 from the outer rim to rotate the pin 31 while pressing it. Alternatively, after rotating the pin 31 from the inner rim, the pin 31 may be pressed into from the outer rim.

The cooling hole 32 forms a flow path for the fluid sucked through the inlet 22 at the center of the impeller 21 to be discharged from the inside to the outside of the fitting portion. Therefore, the fluid is prevented from staying at the center of the impeller 21 and the spindle 8 can be cooled effectively.

Figure 5:
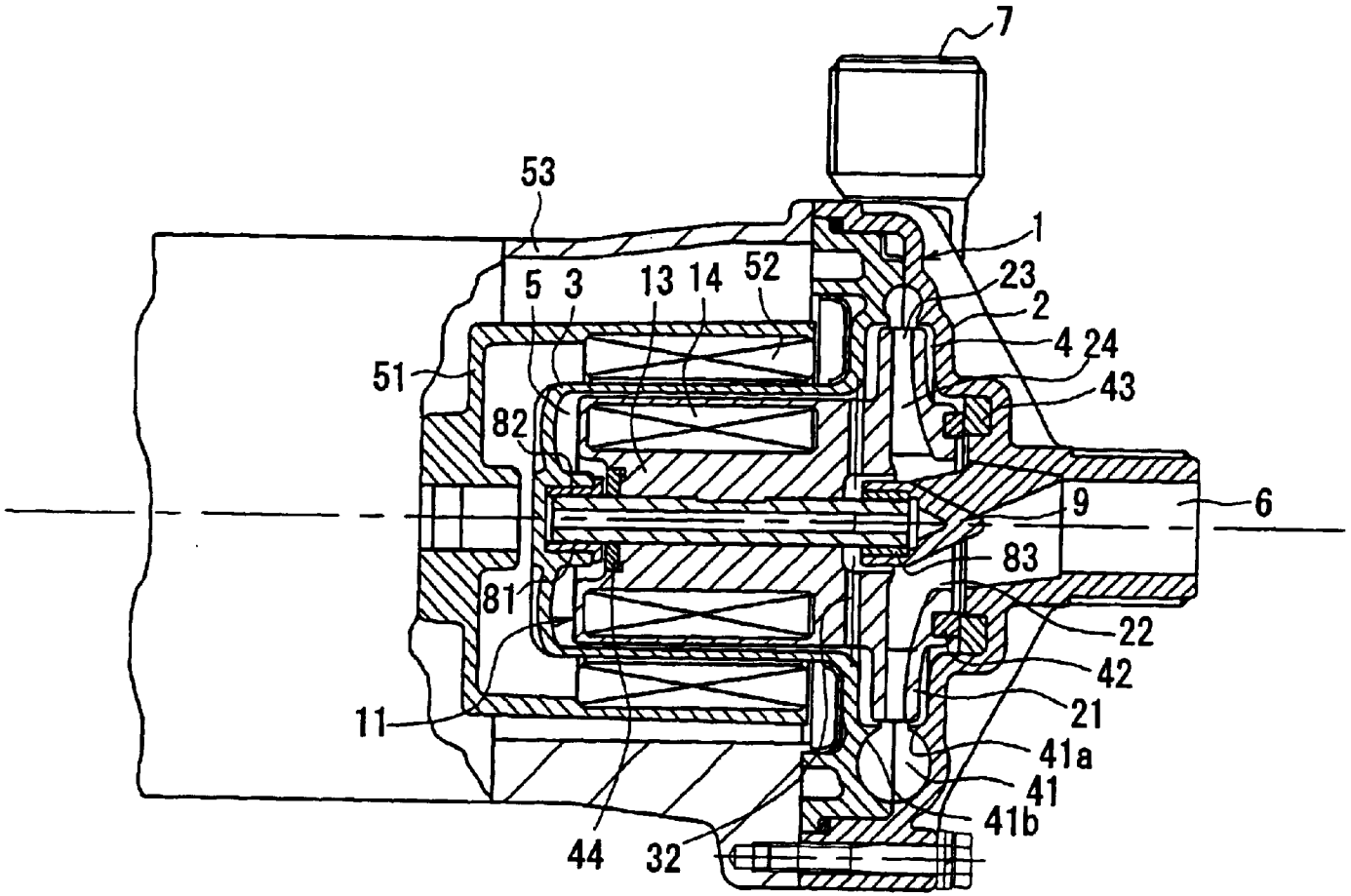
FIG. 5 is a cross-sectional view showing the major part of a magnet pump according to another embodiment of the present embodiment.

FIG. 5 is a cross-sectional view showing the major part of a magnet pump according to another embodiment of the present embodiment. In the previous embodiment the support means for the magnet can 11 includes the fixed spindle 8 and the rotary bearing 12. To the contrary, in this embodiment the support means includes a spindle 81 serving as a rotary shaft fixed at the center of the magnet can 11, and bearings 82, 83 for rotatably supporting the both ends of the spindle 81. The bearing 82 is secured at the rear end of the rear casing 3 and the bearing 83 is secured on a shaft support 9 that extends from the inner rim of the front casing 2 to the center of the impeller housing chamber 4. In this embodiment the magnet can 11 and the impeller 21 are formed integrally, though they may be formed separately and secured by a pin and the like similar to the previous embodiment, needless to say. Other arrangements are same as those of the magnet pump in FIG. 1 and the same reference numerals are given to the corresponding parts to omit their detailed description.

This embodiment also has the same basic operation as that of the previous embodiment.

As described above, in accordance with the present invention, the eddy chamber is formed at the position for dividing the casing into its constituents, or the front casing and the rear casing, along the outer rim of the first housing space to surround the outer rim of the impeller. In addition, the eddy chamber has overhangs formed at the entry thereof hanging over from both sides in the rotational-axis direction of the impeller. Therefore, even if bubbles are mixed into the target fluid sucked from the center and discharged from the outer rim of the impeller, the bubbles discharged from the outer rim of the impeller can be prevented from returning to the first housing chamber along the outer surface of the impeller by the overhangs at the entry of the eddy chamber. This is effective to reduce heating at the sliding portion of the rotator caused by the mixed bubbles, and prevent the synthetic resin casing from deforming and melting.

Additionally, in accordance with the present invention, the cooling hole is formed at the coupling portion between the magnet can and the impeller to flow the target fluid from the axial center thereof to the outside in the radial direction. Therefore, even if bubbles are mixed into the target fluid and the sliding portion of the support means is heated, the high-temperature fluid and bubbles in the vicinity of the sliding portion can be discharged outside and agitated through the cooling hole. This is effective to reduce heat to be caused and prevent temperature elevations in the vicinity of the sliding portion.

What is claimed is:

1. A magnet pump, comprising:

a synthetic resin casing divided into a front casing and a rear casing and configured to internally form a first housing chamber, a second housing chamber contiguous thereto, having an inlet and an outlet formed at said first housing chamber for a target fluid to be transferred;

a substantially cylindrical magnet can with a follower magnet mounted on an outer rim thereof, housed in said second housing chamber;

a support means for rotatably supporting said magnet can relative to said synthetic resin casing;

a disk-like impeller fixed at the front end of said magnet can so as to rotate integrally with said magnet can, having a flow path formed inside to suck said target fluid from the center, transfer said target fluid outward in the radial direction, and discharge said target fluid from an outer rim thereof, and housed in said first housing chamber; and a rotational driving means magnetically coupled to said follower magnet through said rear casing for applying a rotational driving force to said impeller through said follower magnet, wherein said synthetic resin casing has as eddy chamber formed at a position for dividing said front casing and said rear casing to surround the outer rim of said impeller, said eddy chamber having overhangs formed at an entry thereof hanging over from both sides in the rotational-axis direction of said impeller, and wherein a cooling hole is formed at a coupling portion between said magnet can and said impeller to flow said target fluid outward from the axial center thereof in the radial direction.

2. A magnet pump, comprising:

a synthetic resin casing divided into a front casing and a rear casing and configured to internally form a first housing chamber and a second housing chamber contiguous thereto, having an inlet and an outlet formed at said first housing chamber for a target fluid to be transferred;

a substantially cylindrical magnet can with a follower magnet mounted on an outer rim thereof, housed in said second housing chamber;

a support means for rotatably supporting said magnet can relative to said synthetic resin casing;

a disk-like impeller fixed at the front end of said magnet can so as to rotate integrally with said magnet can, having a flow path formed inside to suck said target fluid from the center, transfer said target fluid outward in the radial direction, and discharge said target fluid from an outer rim thereof, and housed in said first housing chamber; and a rotational driving means magnetically coupled to said follower magnet through said rear casing for applying a rotational driving force to said impeller through said follower magnet, wherein a cooling hole is formed at a coupling portion between said magnet can and said impeller to flow said target fluid outward from the axial center thereof in the radial direction, and said magnet can and said impeller are fitted in the axial direction and coupled by a pin passing through the coupling portion in the radial direction.

3. A magnet pump, comprising:

a synthetic resin casing divided into a front casing and a rear casing and configured to internally form a first housing chamber, a second housing chamber contiguous thereto, and an eddy chamber along the outer rim of said first housing chamber, having an inlet formed at said first housing chamber and an outlet formed at said eddy chamber for a target fluid to be transferred;

a substantially cylindrical magnet can with a follower magnet mounted on an outer rim thereof, housed in said second housing chamber;

a support means for rotatably supporting said magnet can relative to said synthetic resin casing;

a disk-like impeller fixed at the front end of said magnet can so as to rotate integrally with said magnet can, having a flow path formed inside to suck said target fluid from the center, transfer said target fluid outward in the radial direction, and discharge said target fluid from an outer rim thereof, and housed in said first housing chamber; and a rotational driving means magnetically coupled to said follower magnet through said rear casing for applying a rotational driving force to said impeller through said follower magnet, wherein said eddy chamber in said synthetic resin casing is formed at a position for dividing said front casing and said rear casing to surround the outer rim of said impeller, said eddy chamber having overhangs formed at an entry thereof hanging over from both sides in the rotational-axis direction of said impeller.

4. The magnet pump according to claim 1, wherein said magnet can and said impeller are fitted in the axial direction and coupled by a pin passing through both in the radial direction.

* * * * *